US012310443B2

(12) United States Patent
Kang

(10) Patent No.: US 12,310,443 B2
(45) Date of Patent: May 27, 2025

(54) HELMET WITH ORNAMENTS

(71) Applicant: Cheol-Ung Kang, Gyeonggi-do (KR)

(72) Inventor: Cheol-Ung Kang, Gyeonggi-do (KR)

( * ) Notice: Subject to any disclaimer, the term of this patent is extended or adjusted under 35 U.S.C. 154(b) by 0 days.

(21) Appl. No.: 18/382,083

(22) Filed: Oct. 20, 2023

(65) Prior Publication Data

US 2025/0009062 A1 Jan. 9, 2025

(30) Foreign Application Priority Data

Jul. 5, 2023 (KR) ..... 10-2023-0087140

(51) Int. Cl.
*A42B 3/04* (2006.01)
*A42B 3/22* (2006.01)
*A42B 3/28* (2006.01)

(52) U.S. Cl.
CPC ..... *A42B 3/0406* (2013.01); *A42B 3/222* (2013.01); *A42B 3/283* (2013.01)

(58) Field of Classification Search
CPC ..... A42B 3/0406; A42B 3/222; A42B 3/283; A42B 3/04; A42B 3/281; A42B 3/28; A42B 3/066; A42B 3/065; A42B 3/06; A42B 3/12; A42B 3/00; A42B 3/003
See application file for complete search history.

(56) References Cited

U.S. PATENT DOCUMENTS 6,332,228 B1 * 12/2001 Takahara ..... A42B 3/003 2/425
2008/0201813 A1 * 8/2008 Yang ..... A42B 3/044 2/7

FOREIGN PATENT DOCUMENTS

CN 113397264 A * 9/2021
JP 2021147731 A * 9/2021

OTHER PUBLICATIONS

Machine translation of JP2021147731 (Year: 2021).*
Machine translation of CN113397264 (Year: 2021).*

* cited by examiner

*Primary Examiner* — Uyen T Nguyen
(74) *Attorney, Agent, or Firm* — IPLA P.A.

(57) ABSTRACT

A helmet with ornaments is provided, which allows a wearer to attach and detach ornament members to a helmet in a one-touch manner to enhance an aesthetic sense. The helmet with ornaments includes: a helmet main body worn on a wearer's head to protect the head; and an ornamental member provided to be attachable and detachable on the helmet main body for decoration of the helmet main body.

2 Claims, 10 Drawing Sheets

HELMET WITH ORNAMENTS

BACKGROUND

The present invention relates to a helmet with ornaments, which allows a wearer to attach and detach ornament members to a helmet in a one-touch manner to enhance an aesthetic sense.

In general, riders using two-wheeled vehicles, such as bicycles, inline skates, and motorcycles, must wear a helmet as a protective means to minimize head injuries in the event of an accident.

The general structure of the helmet will be described. The helmet includes: an outer shell molded from materials like PET resin film, polycarbonate, or fiber-reinforced plastic; a liner bonded with the outer shell, and designed to minimize compressive shocks and prevent head injuries; a pad attached to the inside of the liner to enhance a wearer's comfort with respect to a portion where the wearer's head touches; and chin straps or fitting dials to adjust the helmet size.

Depending on the type of helmet, there are helmets designed not to have ventilation holes (for racing), and helmets designed to have a plurality of ventilation holes that allow air to pass through to cool down heat of the head.

On the other hand, riders enjoys cycling or inline skating while wearing the helmet of the basic form. In addition to wearing the basic helmet, some people wear ornaments on their helmets while cycling or inline skating.

Meanwhile, cited references related to helmets will be reviewed. Korean Patent Publication No. 10-2016-0076948 (entitled 'sports helmet facilitating decoration point expression and equipment attachment and detachment')

The cited reference allows for various devices, such as goggle lenses or small cameras to be easily attached to or detached from the helmet since an ornamental element is coupled to a screw-coupling member formed on the helmet and goggle lenses are provided to be detachably attached to the helmet by the ornamental element.

However, the cited reference has no configuration to mount ornaments for enhancing the aesthetic sense in a one-touch manner.

SUMMARY OF THE INVENTION

Accordingly, the present invention has been made to solve the above-mentioned problems occurring in the prior arts, and it is an object of the present invention to provide a helmet with ornaments, which allows a wearer to attach and detach ornament members to a helmet in a one-touch manner to enhance an aesthetic sense.

To accomplish the above object, according to the present invention, there is provided a helmet with ornaments including: a helmet main body worn on a wearer's head to protect the head; and an ornamental member provided to be attachable and detachable on the helmet main body for decoration of the helmet main body.

Preferably, the helmet main body includes a retaining hole formed on the front thereof and a retaining jaw formed on the rear thereof such that the front of the ornamental member is retained to the retaining hole and the rear of the ornamental member is retained to the retaining jaw, and the ornamental member includes a central portion formed to curve in an arc shape protruding upwards.

Preferably, the retaining hole is formed as a long hole and has both ends facing the front and rear of the helmet main body, thereby increasing a space for air intake.

Preferably, retaining surfaces are formed to extend from both sides of the retaining jaw to the front of the helmet main body, such that the sides of the ornamental member are generally retained and supported.

Preferably, the helmet main body includes ventilation holes formed on both sides thereof to be spaced apart, and an interval between the ventilation holes is formed to be larger than a width of the ornamental member, such that the ventilation holes are not covered by the ornamental member.

Preferably, the ornamental member includes: a branching part divided into both sides from the front and positioned on both sides of the retaining hole; a front jaw formed on the branching part and retained and supported on both sides inside the retaining hole; a rear jaw formed at the rear and retained and supported on the retaining jaw of the helmet main body; and retaining walls extending from both sides of the rear jaw to the branching part and retained to the retaining surfaces of the helmet main body respectively.

Preferably, the helmet main body includes a helmet female-type part 150 formed on the upper side to be concave downwards, and the ornamental member includes an ornamental male-type part formed on the upper portion thereof to be convex downward to be inserted and supported into the helmet female-type part.

Preferably, the helmet female-type part includes side concave walls formed on both sides thereof and a front concave wall extending from ends of the side concave walls. The ornamental male-type part includes both side convex walls formed at both sides thereof to be supported on both side concave walls of the helmet female-type part, and a front convex wall extending to ends of the both side convex walls to be supported on the front concave wall of the helmet female-type part.

Preferably, the helmet main body further includes: a mounting hole which is formed on the front of the helmet main body and to which an additional ornamental member is mounted; and a storage hole formed on the rear of the helmet main body to store the additional ornamental member, and the additional ornamental member includes a mounting pin which is inserted and mounted into the mounting hole or the storage hole.

Preferably, the ornamental member further includes an exposure hole 270 to expose the storage hole of the helmet main body, and when the ornamental member is coupled to the helmet main body, the exposure hole coincides with the storage hole such that the mounting pin of the additional ornamental member passes through the exposure hole and is mounted in the storage hole.

The helmet with ornaments according to the present invention allows a wearer to attach and detach ornament members to a helmet in a one-touch manner to enhance an aesthetic sense.

Furthermore, the helmet with ornaments according to the present invention allows the wearer to selectively mount ornament members, on which various patterns are printed, in accordance with the wearer's preference.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

Hereinafter, the present invention will be described in detail with reference to the accompanying drawings.

Figure 2:
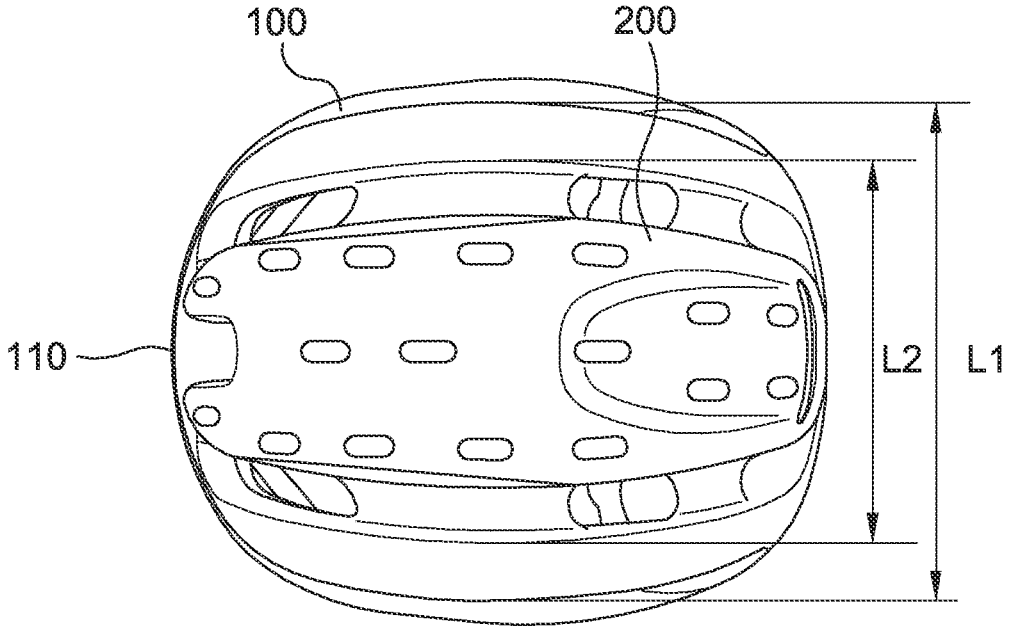
FIG. 2 is a plan view of the present invention.
Figure 3:
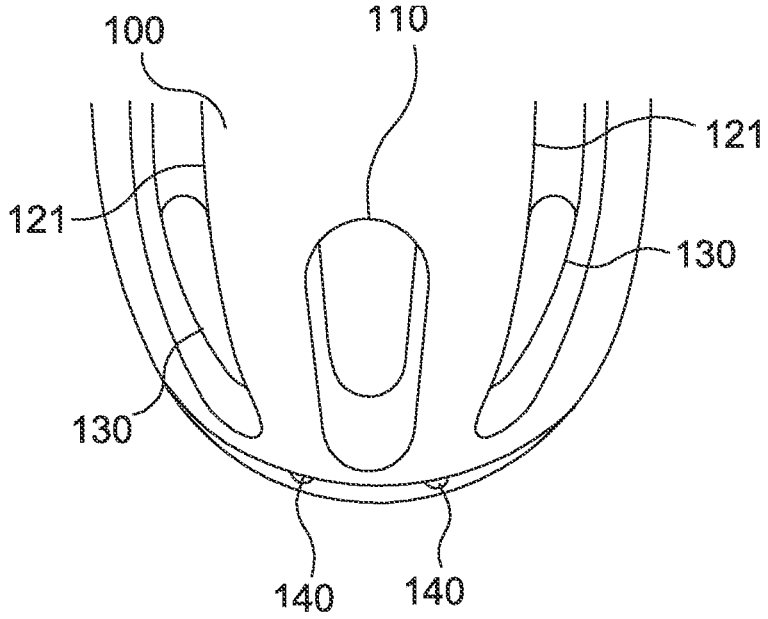
FIG. 3 is a plan view illustrating a retaining hole formed on the helmet of the present invention.

A helmet with ornaments according to an embodiment of the present invention, as illustrated in FIG. 2, includes a helmet main body 100 worn on a wearer's head to protect the wearer's head, and an ornamental member 200 detachably provided on the helmet main body 100 for decoration.

As illustrated in FIGS. 1 through 5, the helmet main body 100 includes a retaining hole 110 formed on the front of the helmet main body 100, and a retaining jaw 120 formed on the rear.

Moreover, the retaining hole 110 is formed as a long hole, and has both ends facing the front and the rear of the helmet main body 100, thereby enabling an expanded space for air intake. When the wearer rides a bicycle while wearing the helmet main body 100 on the head, air cools the heat generated from the head while passing through the retaining hole 110.

The front of the ornamental member 200 is retained to the retaining hole 110, and the rear of the ornamental member 200 is retained to the retaining jaw 120. Therefore, both ends of the ornamental member 200 are retained to the helmet main body 100, thereby ensuring that the retained and fixed state of the ornamental member 200 remains securely in place.

Figure 6:
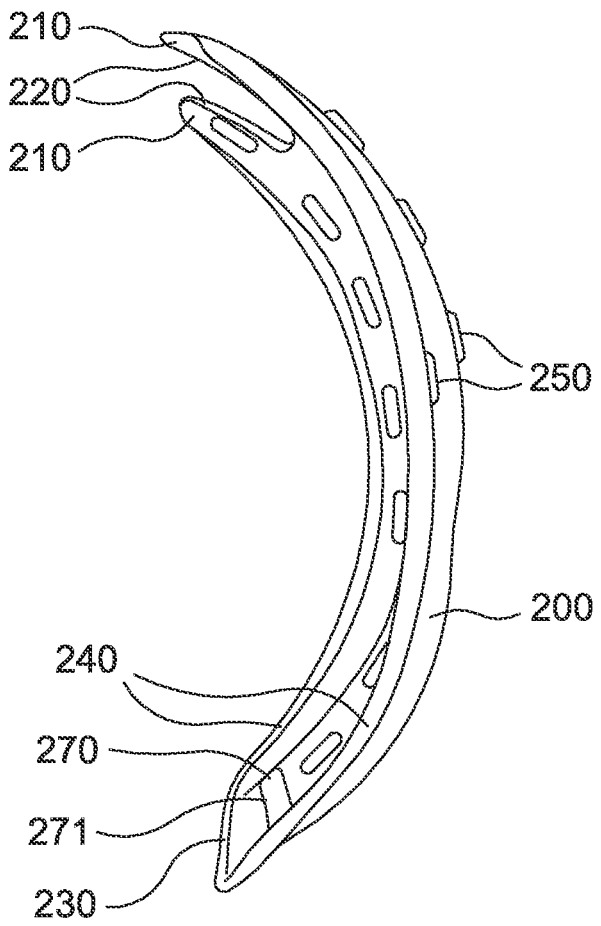
FIG. 6 is a side view illustrating an ornamental element of the present invention.
Figure 7:
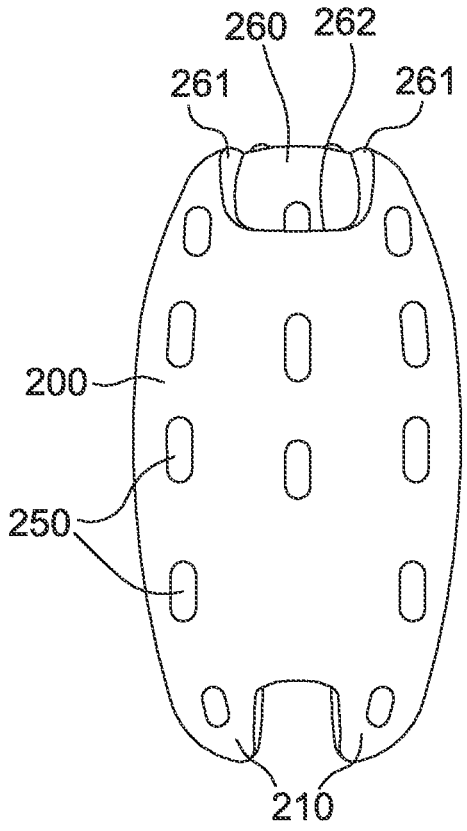
FIG. 7 is a front view illustrating the front side of the ornamental element of the present invention.
Figure 8:
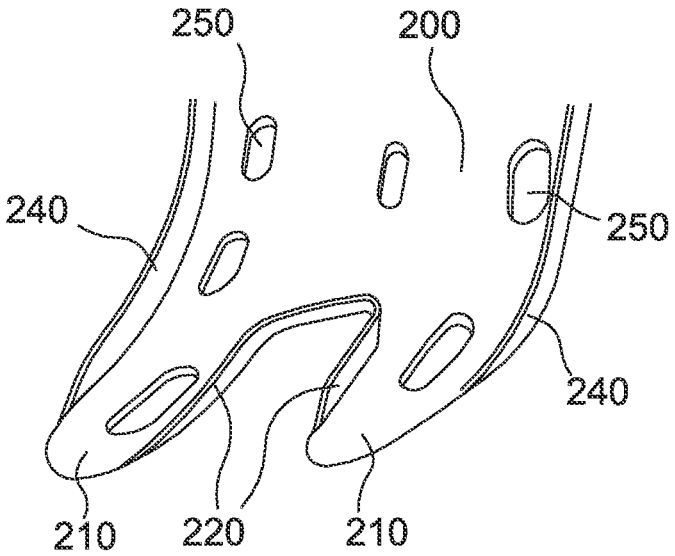
FIG. 8 is a partially enlarged view illustrating an inner portion of the ornamental element of the present invention.

Furthermore, as illustrated in FIG. 6, since the ornamental member 200 is formed to be curved in an arc shape to have elasticity, the ornamental member 200 is supported while getting in surface contact with a curved upper portion of the helmet main bod 100. That is, when the ornamental member 200 is retained to the helmet main body 100 in an expanded state, the retained state can be maintained stably since the ornamental member 200 is returned by the elasticity. Additionally, the ornamental member 200 is not easily took off even if an external shock is transferred to the helmet main body 100. In addition, if the wearer rides the bicycle while wearing the helmet main body 100 on the head, since air presses the ornamental member 200 curved in the arc shape, the ornamental member 200 is not easily separated from the helmet main body 100 while the ornamental member 200 presses the curved upper portion of the helmet main body 100.

As illustrated in FIG. 2, ventilation holes 130 are formed on both sides of the helmet main body 100 to be spaced apart from each other. An interval (L1) of the ventilation holes 130 is larger than a width (L2) of the ornamental member 200. Therefore, air can be easily introduced since the ventilation holes 130 are not covered by the ornamental member 200.

Figure 4:
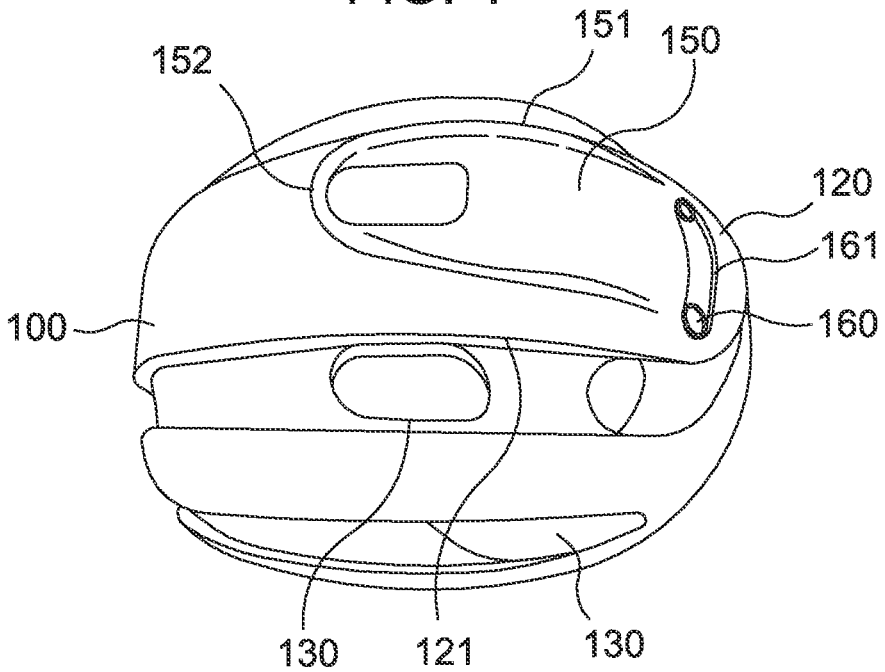
FIG. 4 is a perspective view illustrating a helmet main body of the helmet of the present invention.
Figure 5:
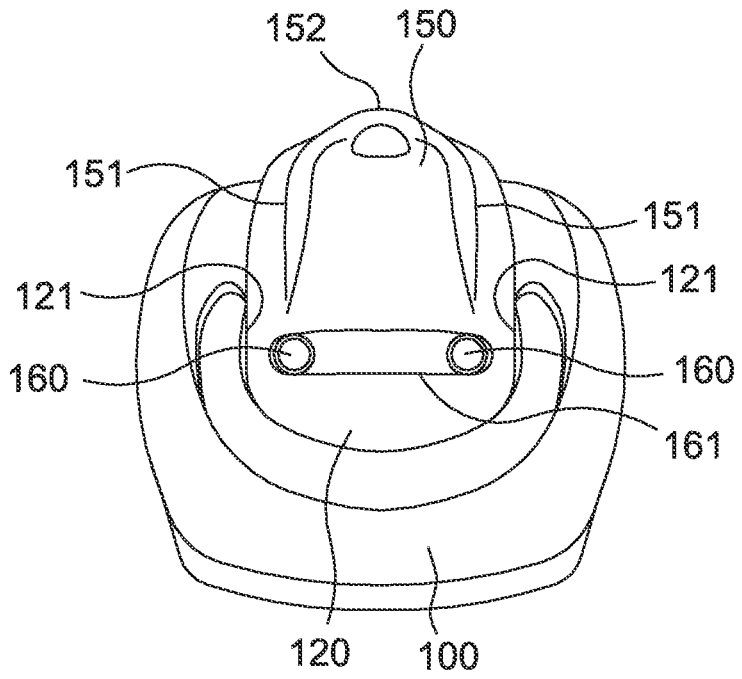
FIG. 5 is a rear view illustrating the rear side of the helmet main body of the present invention.

As illustrated in FIGS. 4 and 5, the retaining jaw 120 protrudes rearward and has retaining surfaces 121 formed on both sides. The retaining jaw 120 generally assumes a 'U' shape. Therefore, an area where the ornamental member 200 is retained increases, to ensure that the attached state of the ornamental member 200 remains firmly in place.

Additionally, the retaining surfaces 121 extend from both sides of the retaining jaw 120 to the front of the helmet main body 100. That is, since both sides of the ornamental member 200 are thoroughly caught and supported, coupling force of the ornamental member 200 to the helmet main body 100 can be increased.

Moreover, the helmet main body 100 includes a helmet female-type part 150 formed on the upper side to be concave downwards. The helmet female-type part 150 includes side concave walls 151 formed on both sides thereof and a front concave wall 152 extending from ends of the side concave walls 151. The front concave wall 152 extends from the both side concave walls 151 to generally form a 'U' shape.

As illustrated in FIGS. 6 through 10, the ornamental member 200 includes: a branching part 210 divided into both sides from the front and positioned on both sides of the retaining hole 110; a front jaw 220 formed on the branching part 210 and retained and supported on both sides inside the retaining hole 110; a rear jaw 230 formed at the rear and retained and supported on the retaining jaw 120 of the helmet main body 100; and retaining walls 240 extending from both sides of the rear jaw 230 to the branching part 210 and retained to the retaining surfaces 121 of the helmet main body 100 respectively.

The ornamental member 200 may be molded from PET resin film, polycarbonate, or fiber-reinforced plastic material.

Moreover, the ornamental member 200 is formed such that the central portion is more convex upwardly than both sides to form an arc shape, thereby providing a robust structure resisting wind. In other words, since the ornamental member 200 is arc-shaped in the back-and-forth direction and in the right-and-left direction, the structure of the ornamental member becomes even more robust.

Since the branching parts 210 are located on both sides of the retaining hole 110, air can easily flow into the retaining hole 110 without interference by the branching parts 210.

As the front jaws 220 are retained to both sides of the retaining hole 110, the retained state can be stably maintained. Moreover, since the front jaws 220 are interconnected in a 'U' shape, the front jaws are extended and caught not only to both sides but also to one side surface of the retaining hole 110 to increase the retained area, thereby enhancing coupling force.

Since the front jaws 220 are secondarily retained to the retaining hole 110 in the state in which the rear jaw 230 is firstly retained to the retaining jaw 120, the retained state of the ornamental member 200 can be maintained stably.

Since the retaining walls 240 are tertiarily retained to the retaining surfaces 121, the coupling force is increased such that the retaining walls 240 of the ornamental member 200 are not lift off from both sides of the helmet main body 100 even by strong wind.

Furthermore, since protrusions 250 are dispersedly formed on the ornamental member 200, it minimizes structural deformation. The protrusions 250 protrude in a long hole shape and have both ends facing both ends of the ornamental member 200. Therefore, when the wearer rides a bicycle while wearing the helmet main body 100 on the head, air is dispersed by the protrusions 250 and presses the ornamental member 200.

Additionally, the ornamental member 200 includes an ornamental male-type part 260 formed on the upper portion thereof to be convex downward to be inserted and supported into the helmet female-type part 150. The ornamental male-type part 260 includes: both side convex walls 261 formed at both sides of the ornamental male-type part 260 to be supported on both side concave walls 151 of the helmet female-type part 150; and a front convex wall 262 extending to ends of the both side convex walls 261 to be supported on the front concave wall 152 of the helmet female-type part 150.

Furthermore, since the ornamental member 200 is generally formed in the 'U' shape from both side convex walls 261 to the front convex wall 262, it ensure a robust structure of the ornamental member 200, thereby prevent deformation and bearing resistance of wind. Additionally, since a process in which the ornamental male-type part 260 of the ornamental member 200 is inserted and supported into the helmet female-type part 150 of the helmet main body 100 is performed first, the ornamental member 200 can be easily and quickly mounted on the helmet main body 100.

Therefore, since the ornamental male-type part 260 of the ornamental member 200 is inserted and supported into the helmet female-type part 150 of the helmet main body 100, the coupling force that the ornamental member 200 is coupled to the helmet main body 100 can be increased.

Figure 11A:
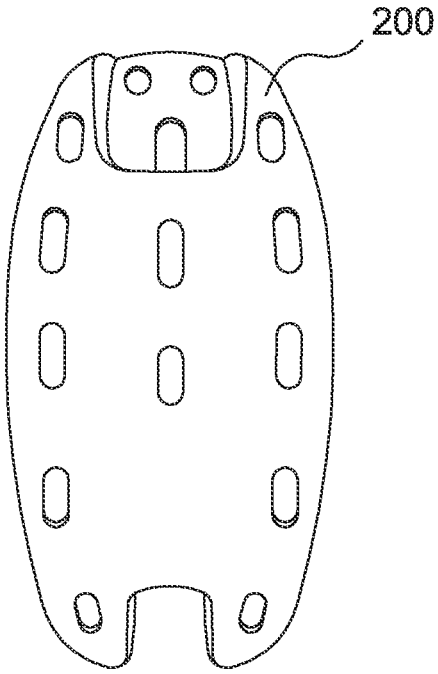
FIGS. 11A and 11B are views illustrating other ornamental elements of the present invention.
Figure 11B:
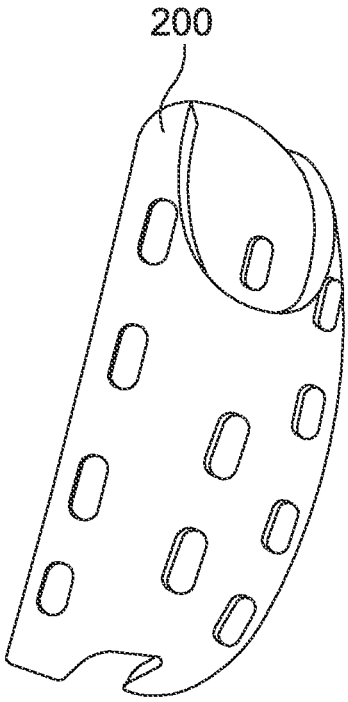
Figure 12A:
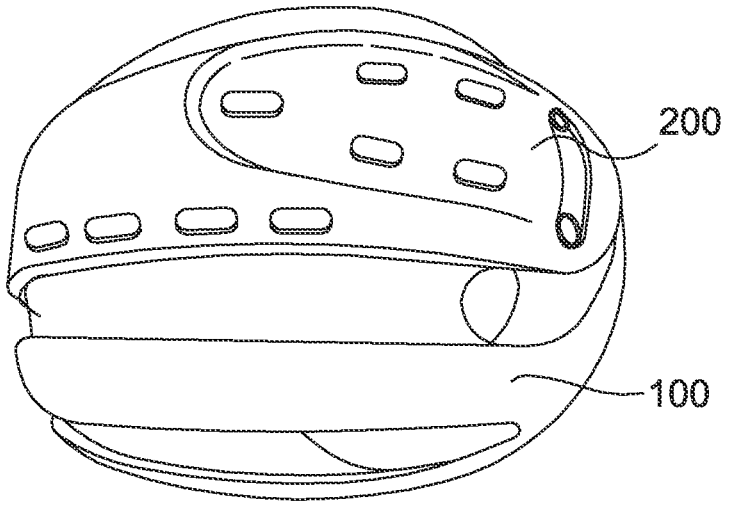
FIGS. 12A and 12B are views illustrating states in which different ornamental elements are respectively mounted on the helmet main bodies.
Figure 12B:
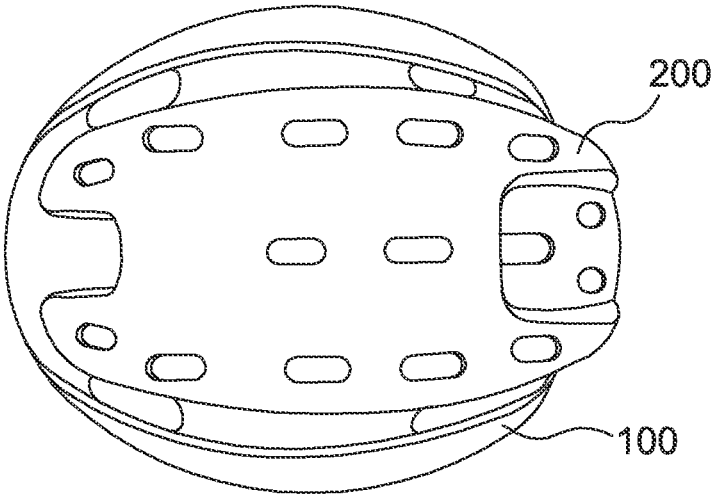

Moreover, FIGS. 11A and 11B illustrate different ornamental members 200 which is solid-colored without any pattern or on which a checkered pattern is printed. As illustrated in FIGS. 12A and 12B, ornamental elements 200 on which various colors or patterns are printed can be selectively mounted on the helmet main body 100. In this manner, various ornamental elements 200 can be selectively mounted on the helmet main body 100 in accordance with the wearer's preference.

Figure 1:
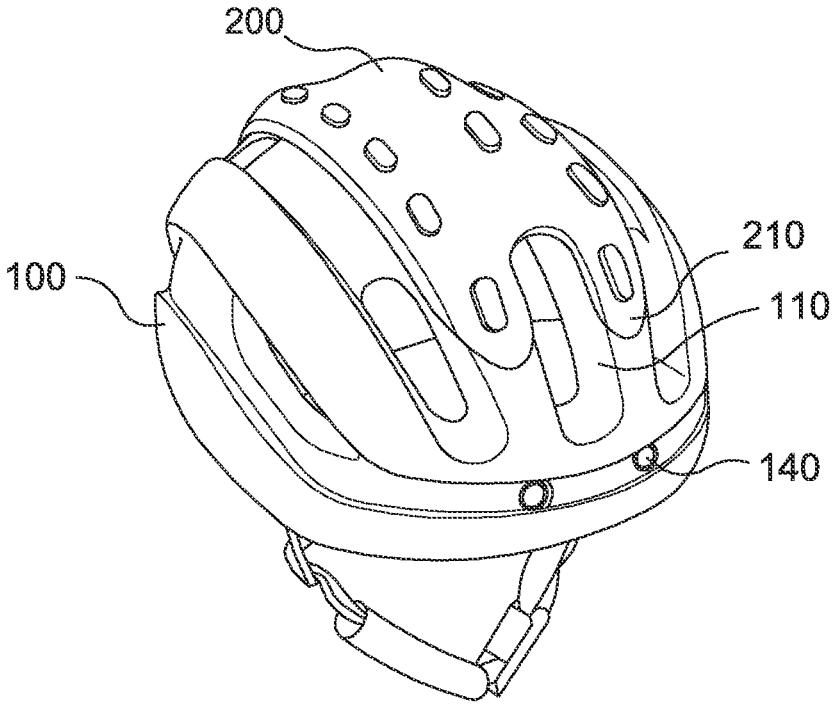
FIG. 1 is a perspective view illustrating a helmet with ornaments according to an embodiment of the present invention.

Meanwhile, as illustrated in FIG. 1, the helmet main body 100 further includes: a mounting hole 140 which is formed on the front of the helmet main body 100 and to which an additional ornamental member 300, such as goggle lenses, is mounted; and a storage hole 160 formed on the rear of the helmet main body 100 to store the additional ornamental member 300, such as goggle lenses, as illustrated in FIGS. 4 and 5.

Figure 13:
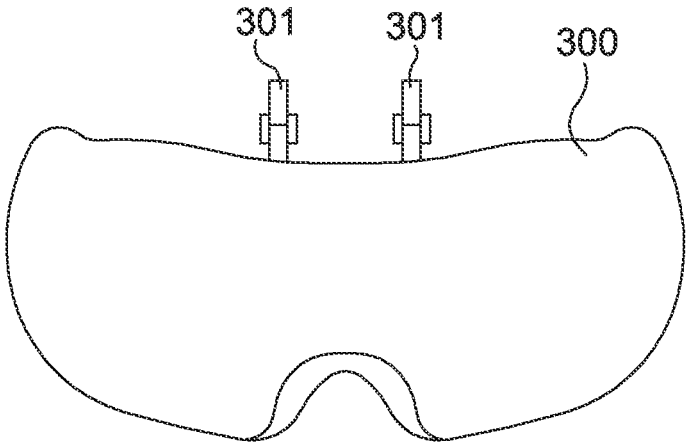
FIG. 13 is a view illustrating another ornamental element of the present invention.

As illustrated in FIG. 13, the goggle lenses, which are the additional ornamental member 300, has mounting pins 301 formed to be inserted and mounted into the mounting hole 140 or the storage hole 160. The mounting pins 301 are rotatably affixed to the goggle lenses, which are the ornamental member 200. In other words, when the mounting pins 301 are forcibly inserted into the mounting hole 140, the ornamental member 200 is conveniently mounted on the helmet main body 100 in a one-touch manner. In addition, the goggle lenses can be rotated based on the mounting pins 301. Furthermore, since the mounting pins 301 may be made of metal and the mounting hole 140 and storage hole 160 may be equipped with magnets, they can be fixed by magnetism when the mounting pins 301 are inserted into the mounting hole 140 or the storage hole 160. That is, the mounting pins 301 are not easily separated from the mounting hole 140 or the storage hole 160 until external pressure is applied.

Figure 14A:
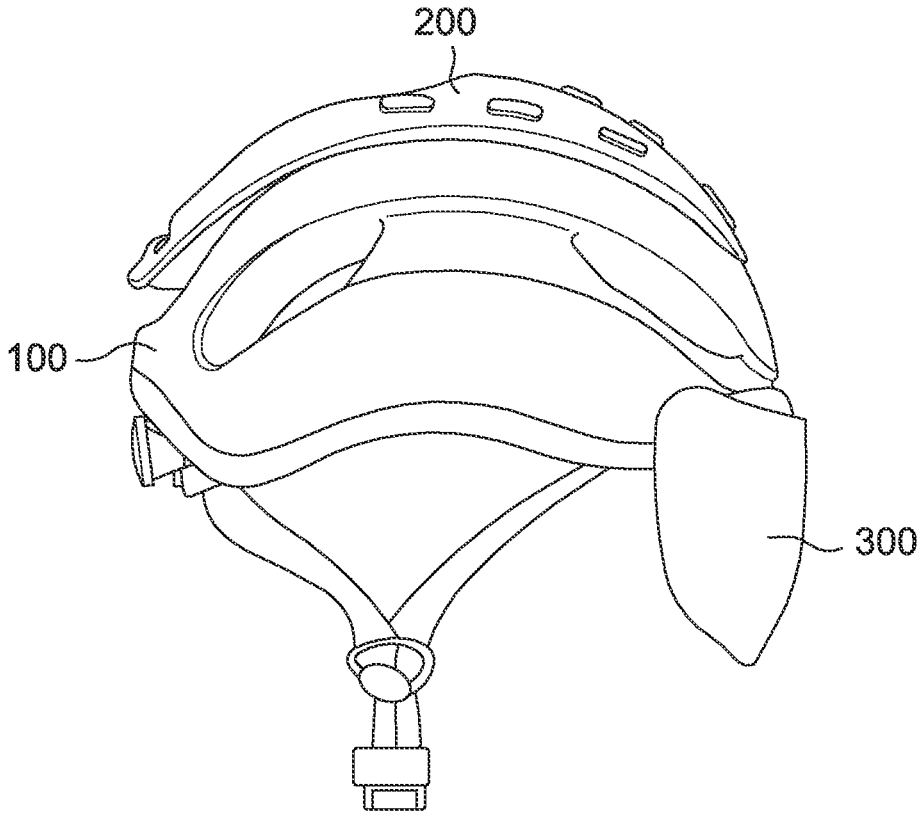
FIGS. 14A and 14B are views illustrating states in which different ornamental elements of the present invention are installed on the front and the rear of the helmet main body.

Therefore, as illustrated in FIG. 14A, when the wearer rotates the goggle lenses downwards so that the goggle lenses are located in front of the wearer's eyes in the state in which the goggle lenses are mounted in the front mounting hole 140, it can prevent glare caused by sunlight. Additionally, the goggle lenses can be rotated upward not to obstruct the user's field of vision.

Figure 14B:
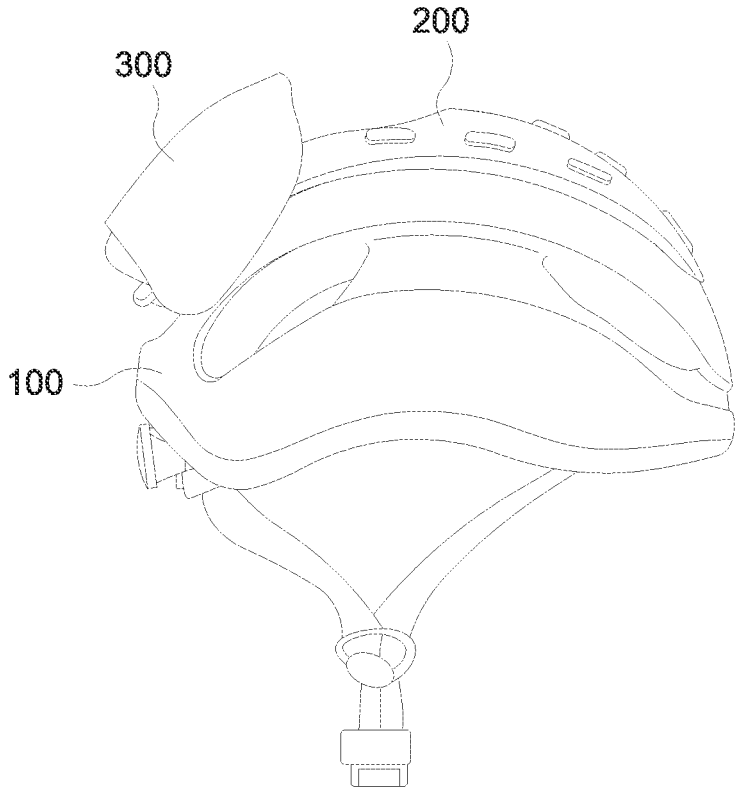

As illustrated in FIG. 14B, since the goggle lenses can be rotated in the state in which the mounting pins 301 are inserted and fixed into the storage hole 160 to get in contact with the helmet main body 100, it can minimize air resistance applied to the goggle lenses while the wearer rides a bicycle. That is, the goggle lenses are not separated from the helmet main body 100 by air resistance and are stably maintained in the stored state during riding. Moreover, the present invention is convenient since there is no need to carry a storage case or bag to store the goggle lenses.

Figure 9:
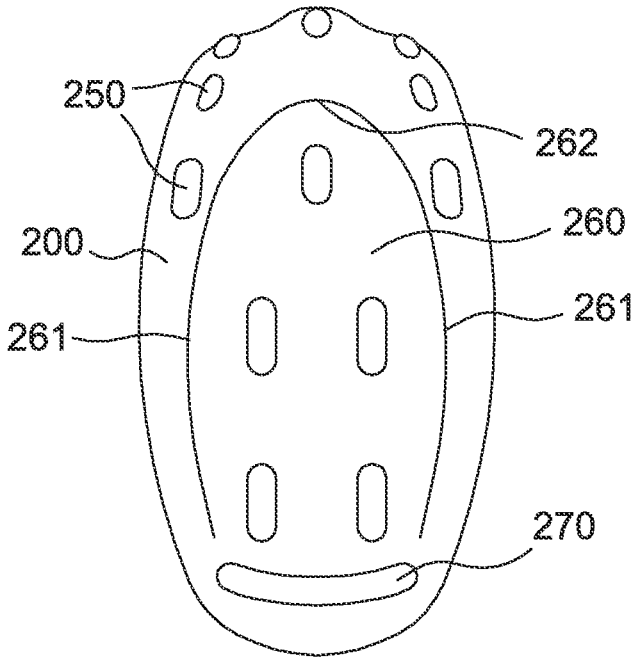
FIG. 9 is a rear view illustrating the rear side of the ornamental element of the present invention.
Figure 10:
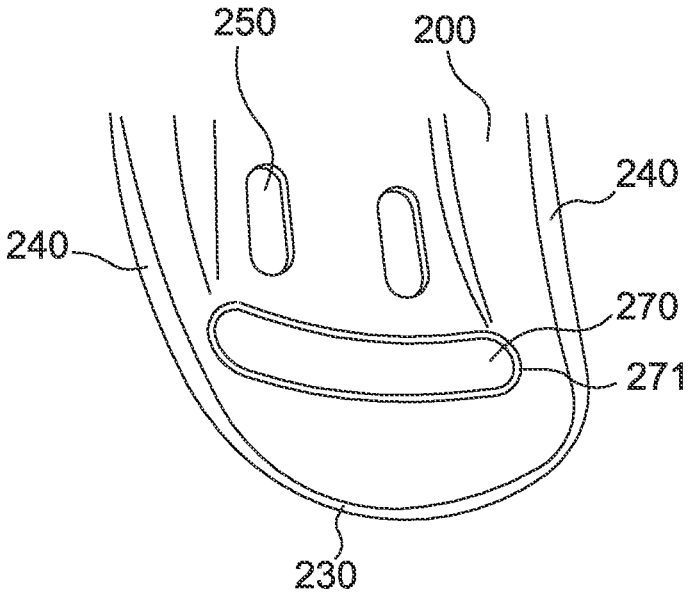
FIG. 10 is a partially enlarged view illustrating another inner portion of the ornamental element of the present invention.

As illustrated in FIGS. 6, 9, and 10, the ornamental member 200 further includes an exposure hole 270 formed to expose the storage hole 160 of the helmet main body 100. Therefore, when the ornamental member 200 is coupled to the helmet main body 100, since the exposure hole 270 coincides with the storage hole 160, the mounting pin 301 of the additional ornamental member 300 can be mounted in the storage hole 160 through the exposure hole 270.

Here, the mounting hole 140 and the storage hole 160 may be formed in plural to be formed to be spaced apart on both sides. That is, since the mounting pins 301 formed on the additional ornamental member 300, which is the goggle lens, are formed in plural, they can be secured to the mounting holes 140 or storage holes 160, thereby ensuring that the goggle lenses remain securely mounted without rotation.

The exposure holes 270 may be long holes formed in the left-right direction so that storage holes 160 are simultaneously exposed.

Moreover, as illustrated in FIGS. 4 and 5, a stepped portion 161 is formed surrounding the storage holes 160. And, as illustrated in FIGS. 6 and 10, the exposure hole 270 has a coupling flange 271 formed along the circumference.

Therefore, when the ornamental member 200 is pressed to the helmet main body 100 in the state in which the exposure holes 270 coincide with the storage holes 160, the coupling flange 271 is forcedly inserted and coupled to the stepped portion 161. Accordingly, the present invention can stably maintain the state in which the ornamental member 200 is coupled to the helmet main body 100.

As described above, the helmet with ornaments according to the present invention is a very useful invention since allowing a wearer to attach and detach ornament members to a helmet in a one-touch manner to enhance an aesthetic sense.

Those skilled in the technical field to which this invention belongs will understand that the present invention can be implemented in other specific forms without changing its technical idea or essential characteristics. Therefore, the embodiments described above should be considered in all respects as illustrative and not restrictive. The scope of the present invention is defined by the claims rather than the detailed description, and all changes or modifications derived from the meaning and the scope of the claims and equivalent concepts should be interpreted as being included within the scope of the present invention.

The invention claimed is:

1. A helmet with ornaments comprising:

a helmet main body (100) worn on a wearer's head to protect the head, and an ornamental member (200) provided to be attachable and detachable on the helmet main body (100) for decoration of the helmet main body (100), wherein the helmet main body (100) further comprises:

a mounting hole (140) which is formed on a front of the helmet main body (100) and to which an additional ornamental member (300) is mounted; and a storage hole (160) formed on a rear of the helmet main body (100) to store the additional ornamental member (300), wherein the additional ornamental member (300) includes a mounting pin (301) which is configured to be inserted and mounted into the mounting hole (140) or the storage hole (160), wherein the ornamental member (200) further includes an exposure hole (270) to expose the storage hole (160) of the helmet main body (100), wherein when the ornamental member (200) is coupled to the helmet main body (100), the exposure hole (270) coincides with the storage hole (160) such that the mounting pin (301) of the additional ornamental member (300) passes through the exposure hole (270) and is mounted in the storage hole (160), wherein a stepped portion (161) is formed surrounding the storage hole (160), wherein the exposure hole (270) has a coupling flange (271) formed along a circumference, wherein the coupling flange (271) is forcedly inserted and coupled to the stepped portion (161) when the ornamental member (200) is pressed to the helmet main body (100) in the state in which the exposure hole (270) coincides with the storage hole (160), wherein the helmet main body (100) includes a retaining hole (110) formed on a front thereof and a retaining jaw (120) formed on a rear thereof, such that a front of the ornamental member (200) is retained to the retaining hole (110) and a rear of the ornamental member (200) is retained to the retaining jaw (120), wherein the ornamental member (200) includes a central portion formed to curve in an arc shape protruding upwards, wherein the retaining hole (110) is formed as an elongated hole and has both ends facing the front and rear of the helmet main body (100), thereby increasing a space for air intake, wherein retaining surfaces (121) are formed to extend from both sides of the retaining jaw (120) to the front of the helmet main body (100), such that sides of the ornamental member (200) are generally retained and supported, wherein the helmet main body (100) includes ventilation holes (130) formed on both sides thereof to be spaced apart, wherein an interval (L1) between the ventilation holes (130) is formed to be larger than a width of the ornamental member (200), such that the ventilation holes (130) are not covered by the ornamental member (200), wherein the ornamental member (200) comprises:

a branching part (210) divided into both sides from the front of the ornamental member and positioned on both sides of the retaining hole (110);

front jaws (220) formed on the branching part (210) and retained and supported on both sides inside the retaining hole (110);

a rear jaw (230) formed at the rear of the ornamental member and retained and supported on the retaining jaw (120) of the helmet main body (100); and retaining walls (240) extending from both sides of the rear jaw (230) to the branching part (210) and retained to the retaining surfaces (121) of the helmet main body (100) respectively, wherein since the front jaws (220) are secondarily retained to the retaining hole (110) in the state in which the rear jaw (230) is firstly retained to the retaining jaw (120), the retained state of the ornamental member (200) can be maintained stably, wherein the helmet main body (100) includes a helmet female-type part (150) formed on an upper side to be concave downwards, and wherein the ornamental member (200) includes an ornamental male-type part (260) formed on an upper portion thereof to be convex downward to be inserted and supported into the helmet female-type part (150), wherein the helmet female-type part (150) includes side concave walls (151) formed on both sides thereof and a front concave wall (152) extending from ends of the side concave walls (151), wherein the ornamental male-type part (260) includes both side convex walls (261) formed at both sides thereof to be supported on both of the side concave walls (151) of the helmet female-type part (150), and a front convex wall (262) extending to ends of the both side convex walls (261) to be supported on the front concave wall (152) of the helmet female-type part (150).

2. A helmet with ornaments comprising:

a helmet main body (100) worn on a wearer's head to protect the head, and an ornamental member (200) provided to be attachable and detachable on the helmet main body (100) for decoration of the helmet main body (100), wherein the helmet main body (100) includes a retaining hole (110) formed on a front thereof and a retaining jaw (120) formed on a rear thereof, such that a front of the ornamental member (200) is retained to the retaining hole (110) and a rear of the ornamental member (200) is retained to the retaining jaw (120), wherein the ornamental member (200) includes a central portion formed to curve in an arc shape protruding upwards, wherein the retaining hole (110) is formed as an elongated hole and has both ends facing the front and rear of the helmet main body (100), thereby increasing a space for air intake, wherein retaining surfaces (121) are formed to extend from both sides of the retaining jaw (120) to the front of the helmet main body (100), such that sides of the ornamental member (200) are generally retained and supported, wherein the helmet main body (100) includes ventilation holes (130) formed on both sides thereof to be spaced apart, wherein an interval (L1) between the ventilation holes (130) is formed to be larger than a width of the ornamental member (200), such that the ventilation holes (130) are not covered by the ornamental member (200), wherein the ornamental member (200) comprises:

a branching part (210) divided into both sides from the front of the ornamental member and positioned on both sides of the retaining hole (110);

front jaws (220) formed on the branching part (210) and retained and supported on both sides inside the retaining hole (110);

a rear jaw (230) formed at the rear of the ornamental member and retained and supported on the retaining jaw (120) of the helmet main body (100); and retaining walls (240) extending from both sides of the rear jaw (230) to the branching part (210) and retained to the retaining surfaces (121) of the helmet main body (100) respectively, wherein since the front jaws (220) are secondarily retained to the retaining hole (110) in the state in which the rear jaw (230) is firstly retained to the retaining jaw (120), the retained state of the ornamental member (200) can be maintained stably, wherein the helmet main body (100) includes a helmet female-type part (150) formed on an upper side to be concave downwards, and wherein the ornamental member (200) includes an ornamental male-type part (260) formed on an upper portion thereof to be convex downward to be inserted and supported into the helmet female-type part (150), wherein the helmet female-type part (150) includes side concave walls (151) formed on both sides thereof and a front concave wall (152) extending from ends of the side concave walls (151), wherein the ornamental male-type part (260) includes both side convex walls (261) formed at both sides thereof to be supported on both of the side concave walls (151) of the helmet female-type part (150), and a front convex wall (262) extending to ends of the both side convex walls (261) to be supported on the front concave wall (152) of the helmet female-type part (150), wherein since a process in which the ornamental male-type part (260) of the ornamental member (200) is inserted and supported into the helmet female-type part (150) of the helmet main body (100) is performed first, the ornamental member (200) can be easily and quickly mounted on the helmet main body (100), wherein the helmet main body (100) further comprises:

a mounting hole (140) which is formed on a front of the helmet main body (100) and to which an additional ornamental member (300) is mounted; and a storage hole (160) formed on a rear of the helmet main body (100) to store the additional ornamental member (300), wherein the additional ornamental member (300) includes a mounting pin (301) which is configured to be inserted and mounted into the mounting hole (140) or the storage hole (160), wherein the ornamental member (200) further includes an exposure hole (270) to expose the storage hole (160) of the helmet main body (100), and wherein when the ornamental member (200) is coupled to the helmet main body (100), the exposure hole (270) coincides with the storage hole (160) such that the mounting pin (301) of the additional ornamental member (300) passes through the exposure hole (270) and is mounted in the storage hole (160), wherein a stepped portion (161) is formed surrounding the storage hole (160), wherein the exposure hole (270) has a coupling flange (271) formed along a circumference, and wherein the coupling flange (271) is forcedly inserted and coupled to the stepped portion (161) when the ornamental member (200) is pressed to the helmet main body (100) in the state in which the exposure hole (270) coincides with the storage hole (160).

* * * * *